US005345775A

United States Patent [19]

Ridenour

[11] Patent Number: 5,345,775

[45] Date of Patent: Sep. 13, 1994

[54] REFRIGERATION SYSTEM DETECTION ASSEMBLY

[76] Inventor: Ralph G. Ridenour, 626 Lexington-Ontario Rd., Mansfield, Ohio 44903

[21] Appl. No.: 25,584

[22] Filed: Mar. 3, 1993

[51] Int. Cl.[5] ..... F25D 21/06

[52] U.S. Cl. ..... 62/140; 62/156

[58] Field of Search ..... 62/140, 125, 126, 128, 62/129, 151, 155, 156, 234

[56] References Cited

U.S. PATENT DOCUMENTS

| | | | |
|---|---|---|---|
| 3,010,288 | 11/1961 | Jacobs | 62/155 |
| 3,335,576 | 8/1967 | Phillips | 62/156 |
| 3,362,183 | 1/1968 | Sutton, Jr. | 62/140 |
| 3,633,374 | 1/1972 | Canter | 62/156 |
| 4,037,427 | 7/1977 | Kramer | 62/128 |
| 4,176,524 | 12/1979 | Kamiyama et al. | 62/140 |
| 4,215,554 | 8/1980 | Pohl | 62/156 |
| 4,305,259 | 12/1981 | Jaeschke | 62/140 |
| 4,345,441 | 8/1982 | Hansen | 62/156 X |
| 4,347,709 | 9/1982 | Wu et al. | 62/140 |
| 4,409,795 | 10/1983 | Krueger | 62/140 |
| 4,432,211 | 2/1984 | Oishi et al. | 62/155 |
| 4,633,673 | 1/1987 | Morrison et al. | 62/129 |
| 4,787,212 | 11/1988 | Hessey | 62/128 X |
| 4,932,217 | 6/1990 | Meyer | 62/156 |
| 4,993,233 | 2/1991 | Borton et al. | 62/155 |
| 4,998,412 | 3/1991 | Bell | 62/126 |

FOREIGN PATENT DOCUMENTS 101533 10/1979 Japan .

*Primary Examiner*—Harry B. Tanner

*Attorney, Agent, or Firm*—Pearne, Gordon, McCoy & Granger

[57] ABSTRACT

A detection assembly is for a refrigeration system which has a cooling unit subject to frost build-up and defrost-to-drain. The assembly includes a first thermal sensor normally exposed to air but also to frost on the cooling unit or water in a plugged drain. A frost or water detection circuit has an input from the first thermal sensor, the detection circuit detects build-up of frost around the first thermal sensor and generates a defrost initiate DI signal which is connected to terminate the refrigeration to the cooling unit and then to initiate a defrost cycle wherein heat is applied to defrost the cooling unit. A second thermal sensor is in good thermal contact with said cooling unit, and a defrost terminate circuit has an input from said second thermal sensor to terminate the defrost cycle. A similar detection circuit determines the existence of ice or water in a plugged drain and terminates the refrigeration or indicates an alarm, or both. The foregoing Abstract is merely a resume of general applications, it is not a complete discussion of all principles of operation or applications, and is not to be construed as a limitation on the scope of the claimed subject matter.

18 Claims, 7 Drawing Sheets

Fig. 2
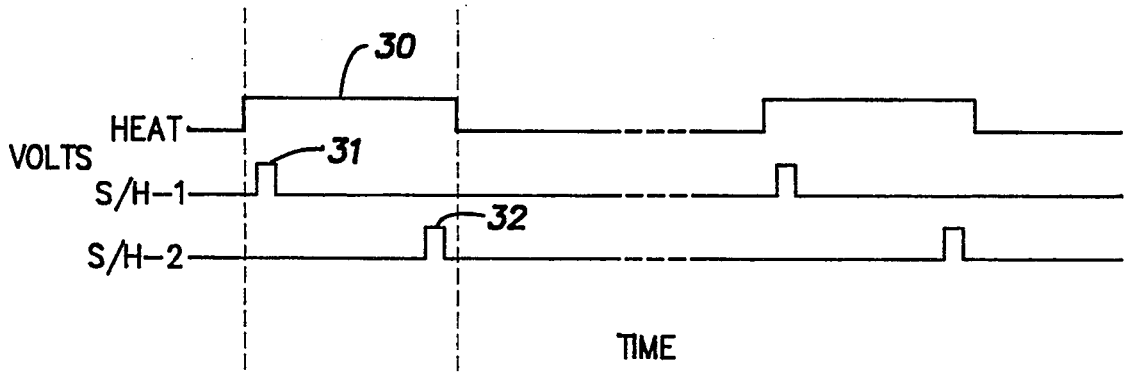
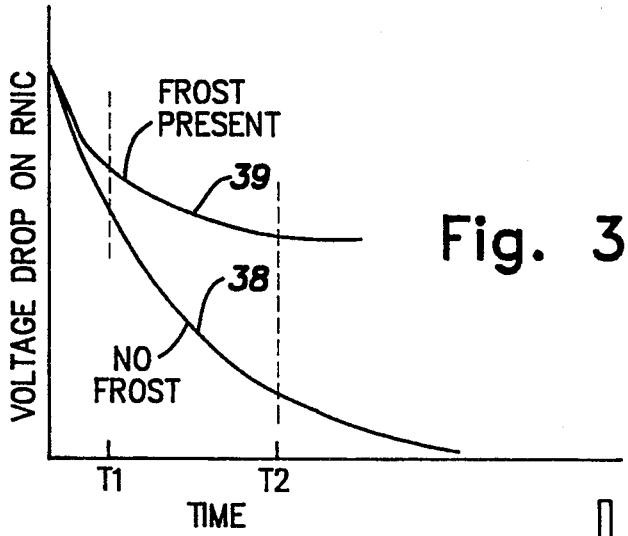
Fig. 3
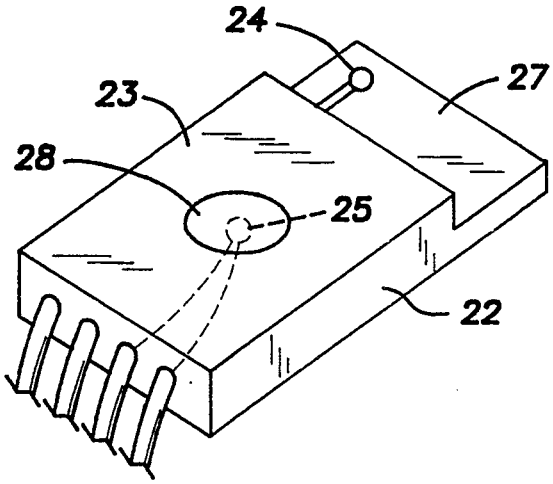
Fig. 4
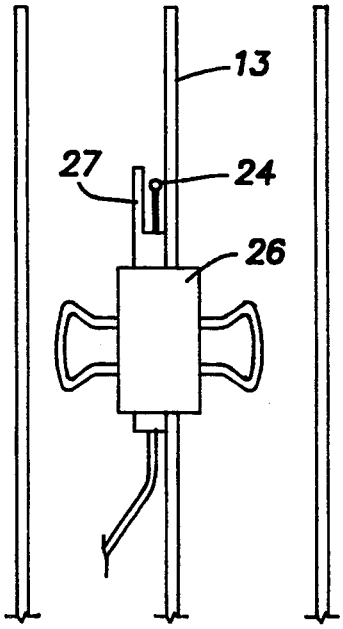
Fig. 5

REFRIGERATION SYSTEM DETECTION ASSEMBLY

BACKGROUND OF THE INVENTION

In refrigeration systems or air conditioning systems such as used in supermarkets or large buildings, there are usually several refrigeration units, one for each of the refrigeration cases, for example. A large portion of energy costs is spent on defrosting ice or frost from the refrigerated coils. The defrosting is normally done with a manual or electronic timer or facility management system. The use of a timer is very inefficient because the refrigeration is on for a certain time and then the defrosting is on for another period of time. This does not take into account many variables such as the humidity in the air, the ambient air temperature, how full the refrigerator cases are with produce, how much of the cold air is recirculated and how much is lost, the temperature of the product placed in the refrigerated cases, the number of people walking by the cases, how often the doors are opened or left opened, by drafts and currents near the cases, by poorly designed cases with lower openings or air leaks, and many other variable factors. Using a timer, if the humidity is low the defrosting is too often. If the humidity is high there is frost and ice on the cooling unit so it doesn't cool down the refrigerator case as quickly. Accordingly, the timer system of control of defrost will usually have to be set at an average and in the winter dry season or at nighttime in a supermarket, defrosting may be occurring for too long a time and much too frequently. On the other hand during the highly humid days in the summer or during the heavily active daytime hours of the supermarket, the refrigerator coils may build-up a thick coating of frost before defrosting occurs and this thickness of ice reduces the thermal efficiency of the refrigeration unit.

SUMMARY OF THE INVENTION

A detection assembly for frost or water in a refrigeration system having a cooling unit subject to frost build-up and defrost water to a drain, said assembly comprising, in combination:

a first thermal sensor normally exposed to air and mounted in said refrigeration system at a location subject to build-up of frost or water;

a detection circuit having an input from said first thermal sensor;

means in said detection circuit to energize said first thermal sensor with a voltage sufficiently high to cause said first thermal sensor to self-heat; and means to compare the resistance of said first thermal sensor at two different times to detect the presence of frost or water around said first thermal sensor and to generate a first signal;

said first signal connected to terminate the refrigeration to said cooling unit.

The invention also includes a plugged drain detection assembly for a refrigeration system having a cooling unit subject to frost build-up and a defrost-to-drain, said assembly comprising, in combination:

a thermal sensor exposed to air and mounted in the refrigeration system drain;

a plugged drain detection circuit having an input from said thermal sensor;

means in said plugged drain detection circuit to detect build-up of frost or water around said thermal sensor and to generate a plugged drain signal;

said plugged drain signal connected to terminate the refrigeration to said cooling unit.

The invention further includes a defrost-on-demand assembly for a refrigeration system having a cooling unit subject to frost build-up, said assembly comprising, in combination:

a first thermal sensor exposed to air and mounted a small distance from a cooling unit subject to frost build-up;

a frost detection circuit having an input from said first thermal sensor;

means in said frost detection circuit to detect build-up of frost around said first thermal sensor and to generate a defrost initiate DI signal; and said DI signal connected to terminate the refrigeration to said cooling unit.

Accordingly, an object of the invention is to provide a detection assembly which detects build-up of frost or water and to terminate the refrigeration.

Another object of the invention is to eliminate a timer and provide defrost of a refrigeration unit only when needed.

Another object of the invention is to periodically check a refrigeration unit and to initiate defrost only when required.

Another object of the invention is to provide a refrigeration system with a frost detection circuit and a defrost terminate circuit so that after frost is detected and defrosting is initiated, it is terminated only if and when all frost has been removed from the cooling unit.

Other objects and a fuller understanding of the invention may be had by referring to the following description and claims, taken in conjunction with the accompanying drawings.

BRIEF DESCRIPTION OF THE DRAWINGS

FIG. 2 is a graph of volts vs. time generated in the circuit;

FIG. 3 is a graph of volts vs. time on a resistor in series with a first thermistor;

FIG. 4 is an isometric view of a block mounting first and second thermistors;

FIG. 5 is an elevational view of the sensor block spring mounted to a cooling fin;

DESCRIPTION OF THE PREFERRED EMBODIMENT

Figure 1:
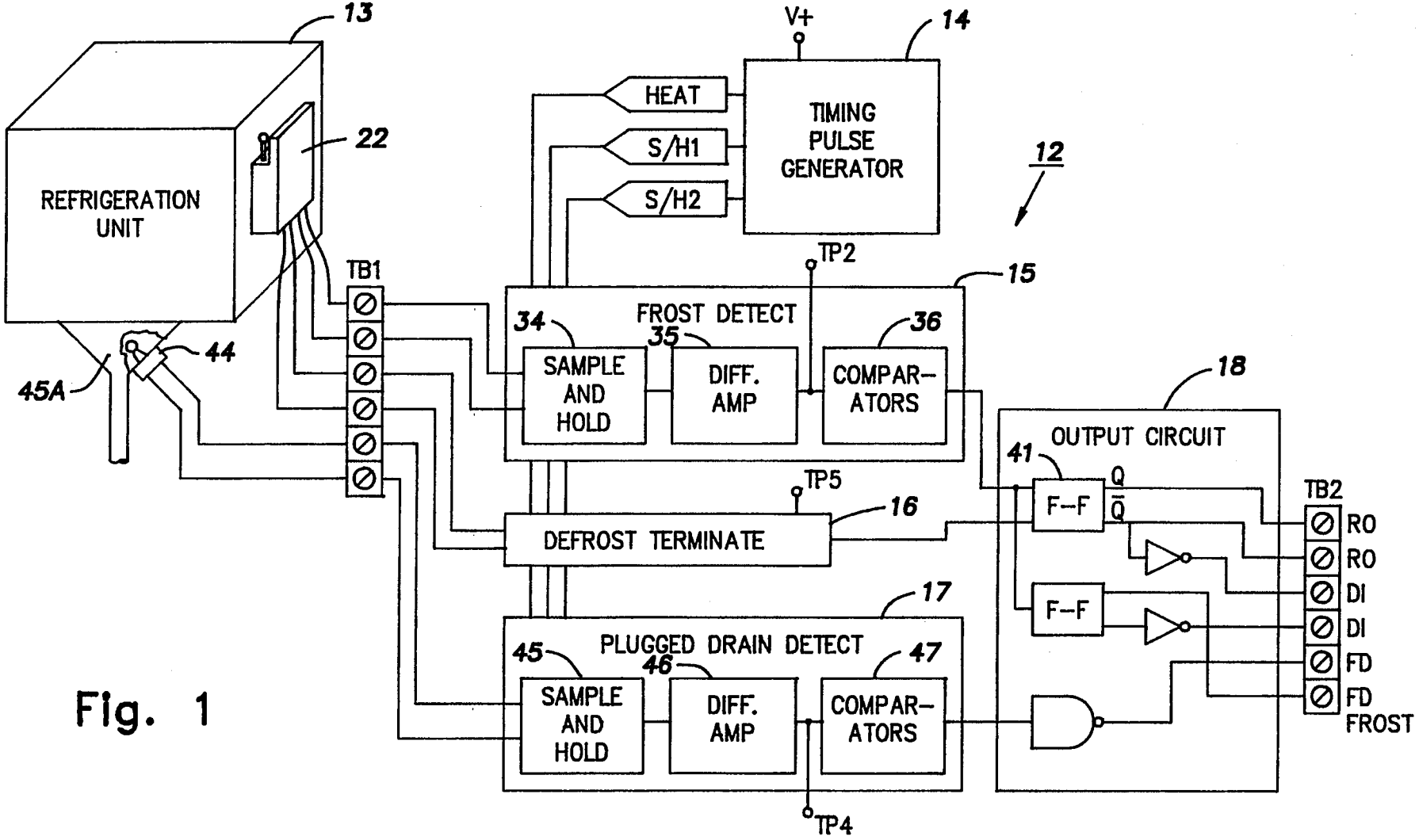
FIG. 1 is a block diagram of a refrigeration system detection assembly according to the invention.
Figure 6:
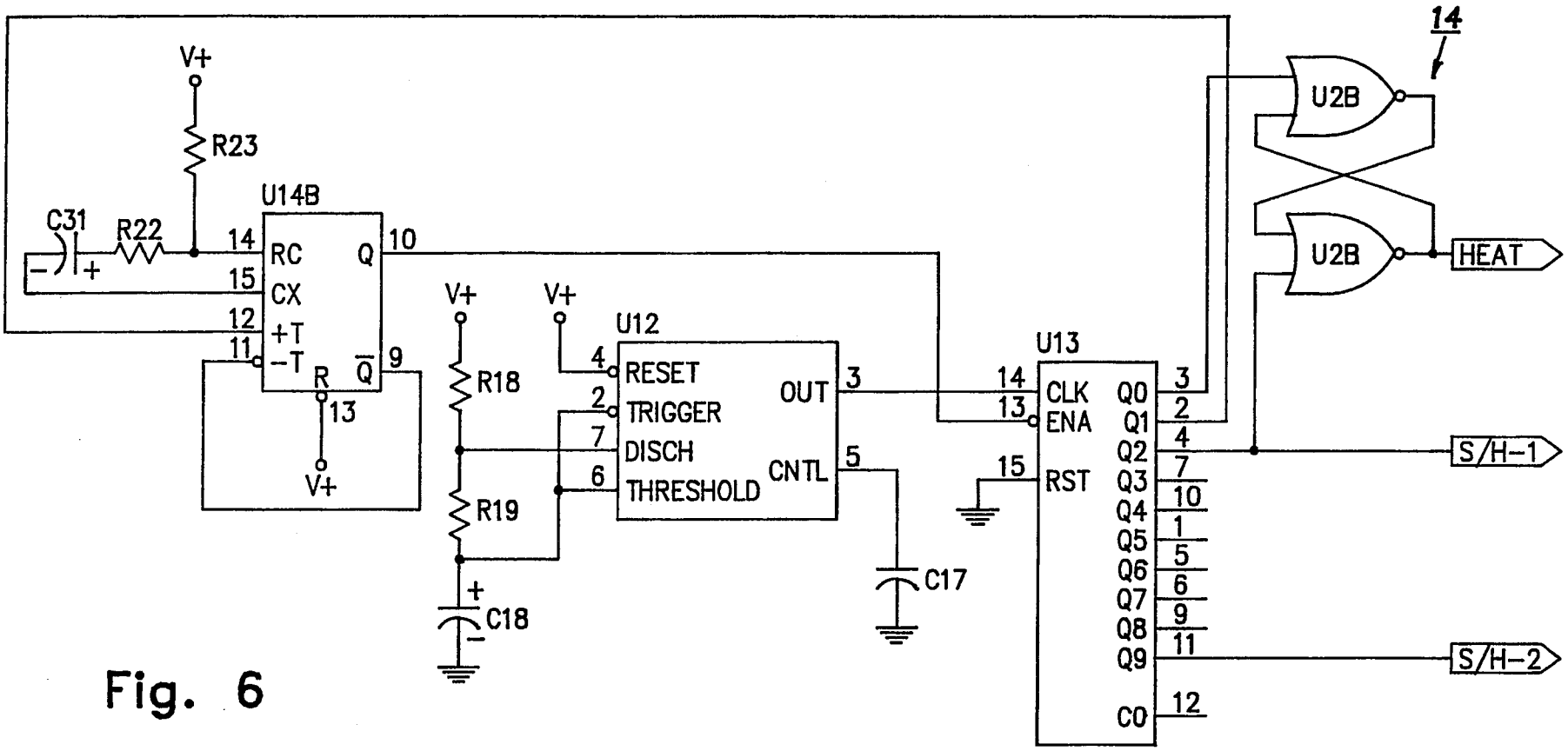
FIG. 6 is a schematic diagram of a timing pulse generator.

FIG. 1 illustrates a refrigeration system detection assembly 12 which is for a refrigeration unit 13. This may be a coil or a coil with cooling fins thereon for use in a refrigerated case of a supermarket, for example, or in an air conditioning system. The detection assembly 12 includes a timing pulse generator 14 which produces voltage pulses as shown in FIG. 2 to cyclically operate the circuit. These generated pulses are supplied to a frost detection circuit 15, a defrost terminate circuit 16, and a plugged drain detection circuit 17. The last three mentioned circuits are connected to an output circuit 18 shown in FIG. 10.

A mounting block 22 is shown in FIGS. 1, 4 and 5. This mounting block has a mounting surface 23 and the block may be made of plastic. A first thermal sensor 24 is preferably a positive temperature coefficient thermistor and is mounted in the block 22 so as to be exposed to the air and to any frost build-up on the refrigeration unit 13. The mounting surface is mounted to the refrigeration unit such as a refrigeration coil or a fin connected to the coil by a spring clip 26 as shown in FIG. 5. The first thermal sensor is physically supported in the block but is exposed to the air and physically protected by a shield 27. The second thermal sensor 25 is embedded within the block 22 and more specifically within mass 28 which is a plastic material of high thermal conductivity. By this means the second thermal sensor is in good thermal contact with the temperature of the cooling unit 13. The first thermal sensor 24 as will be noted from FIG. 5 is mounted so that it is physically protected by the shield 27 and yet is mounted within a small distance in the order of 1/16", from the cooling unit 13. Thus it is mounted in free air yet if there is any frost build-up on the cooling unit 13 which exceeds 1/16", it will touch the first thermal sensor 24 or embed it in the frost.

Figure 7:
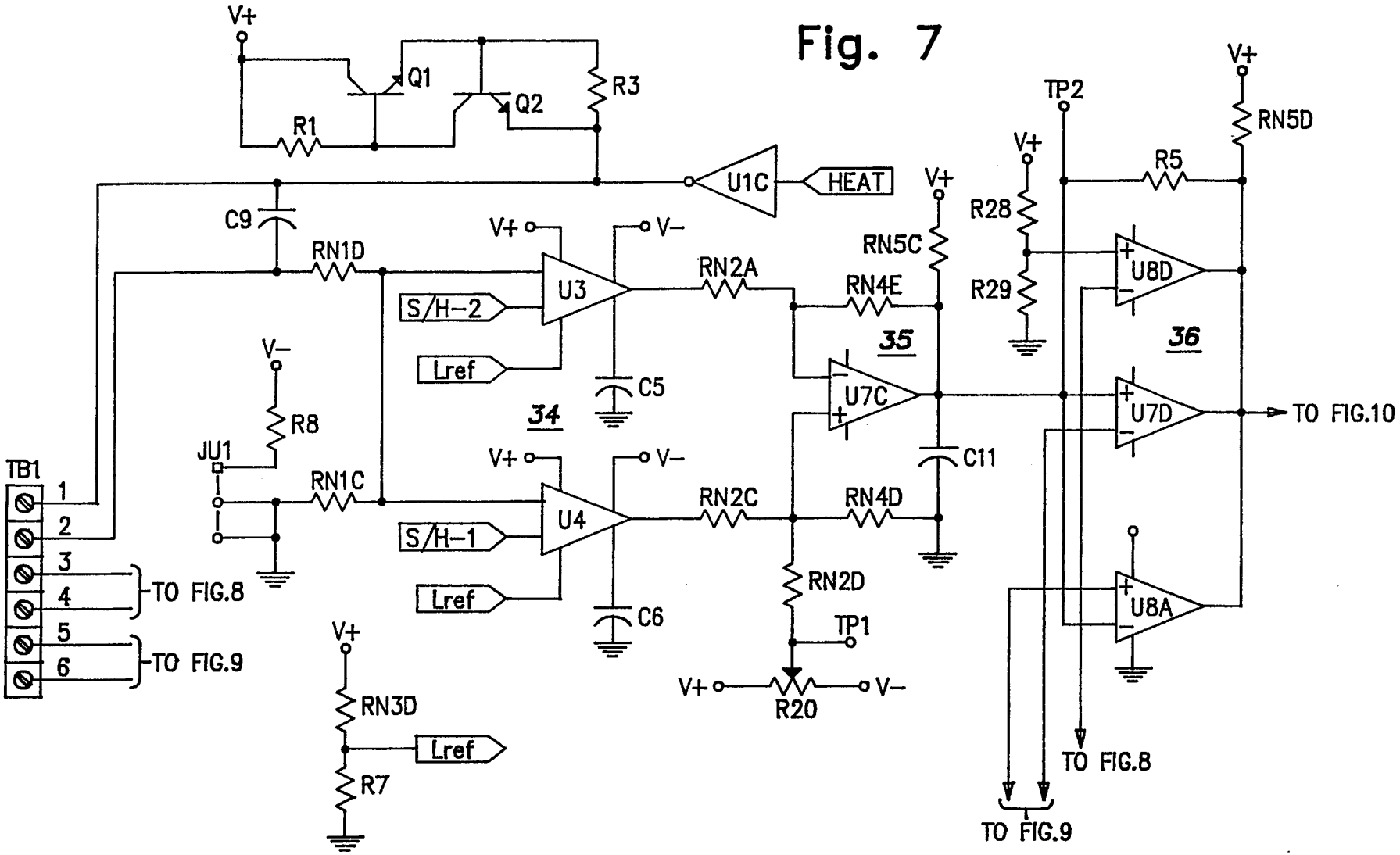
FIG. 7 is a circuit diagram of a frost detection circuit.

FIG. 1 shows a timing pulse generator 14 and it generates three different pulse streams shown in FIG. 2 as heat, curve 30, sample and hold—1, curve 31, and sample and hold—2, curve 32. The length of the curve 30 where the pulse is on, in one embodiment, is about 3.7 seconds and the off period is something considerable longer, such as 40 seconds. The pulse 31 lasts for about 350 milliseconds as does pulse 32. These pulses 31 and 32 are thus about 3 seconds apart. These pulses are used in the frost detection circuit 15 as well as in the plugged drain detection circuit 17 which has similar components. The frost detection circuit 15 has sample and hold circuit 34, a difference amplifier 35 and comparators 36. Let us presume that the refrigeration unit 13 has just been defrosted so that there is little or no frost build-up on this cooling unit. In this case FIG. 3 shows a curve 38 with no frost and another curve 39 where the frost is present in sufficient thickness to touch or embed the first thermal sensor 24. The HEAT output terminal of the timing pulse generator 14 supplies a fairly large current to the first thermal sensor 24 so that it rapidly heats up between time T1 and time T2, the times between pulses 31 and 32. This gives a rather large change of resistance as shown in FIG. 3. Resistor RN1C shown in FIG. 7 is in series with the first thermal sensor 24 so that it has a voltage drop decreasing in proportion to the increasing resistance of the thermal sensor. This large voltage drop is sampled at the two times T1 and T2 by the sample and hold circuit 34 and is then passed to the difference amplifier 35. In this case of no frost being present, the difference amplifier will detect a large voltage difference and this is passed to the comparators 36. From the comparators 36 it goes to the output circuit 18 and to an output terminal RO of a terminal board TB2 and no defrost cycle is initiated.

The cycles of FIG. 2 keep repeating on and on until sometime later which might be 2 minutes or might be 6 hours when frost has built up to the point where the first thermal sensor 24 is touched by the frost or embedded in the frost. In such case the curve 39 of FIG. 3 controls the operation. With frost present, this keeps the first thermal sensor quite cool, and the temperature and resistance of this first thermal sensor increases only slightly between times T1 and T2. In such case the voltage drop across the input resistor RN1C in the sample and hold circuit 34 does not increase much and therefore when this signal is passed to the difference amplifier 35, the difference between the two voltages on RN1C is quite small. This small voltage passed to the comparators 36 means that there will be an output signal from the comparators which is passed to the output circuit 18 and the $\overline{Q}$ output on a flip-flop 41 will go high and the third terminal on the terminal board DB2 will emit a DI signal which is a defrost initiate signal. This turns off the refrigeration to the cooling unit 13 and after a short time period turns on a defrosting cycle. The defrosting supplies heat in any number of ways to the cooling unit 13 to melt the frost or ice on it. The cycling of FIG. 2 will continue but will not affect the refrigeration output terminals or the defrost initiate terminals.

Figure 8:
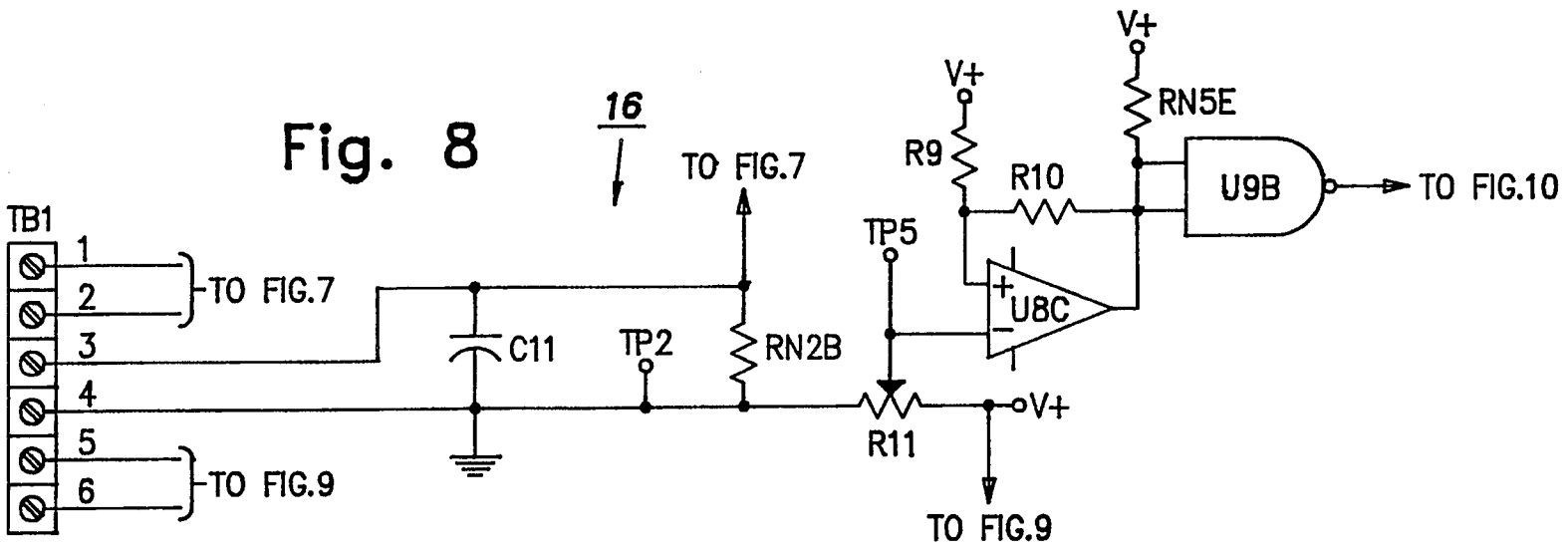
FIG. 8 is a circuit diagram of a defrost terminate circuit.

The defrost terminate circuit 16 next comes into play. This is shown in FIGS. 1 and 8 when the defrosting has proceeded to such a point that the temperature of the cooling unit 13 as measured by the second thermal sensor 25 is above the freezing point, e.g. 35° F., then the resistance of the thermistor 25 will increase slightly and the voltage drop across resistor RN2B will decrease slightly. This is passed to the comparators in FIG. 7, specifically to U8D and its output will change state so that the flip-flop 41 in the output circuit will change state to terminate the defrost heating. Preferably a short time in the order of 5–20 seconds is allowed for any dripping of water droplets from the cooling unit 13. After this short time period the defrosting is terminated and the refrigerant output terminals RO are again energized to again supply refrigeration to the refrigeration unit 13.

The plugged drain detection circuit 17 has a third thermal sensor or thermistor 44 which is mounted in the drain 45A of the refrigeration unit 13. It is plausible for the refrigeration drain to become plugged with labels which have come off various products in their refrigeration case or mold may grow in the drain outlet so that ice or water can immerse the third thermal sensor 44. In some cases, it has been found that a large block of ice can be formed in the bottom of the refrigeration case which is about three inches thick and eight feet long and three feet wide. If the stock boy chips the ice away, he can cut wires or cut through the cooling coils to release freon which is an environmental hazard. If the plug drain causes water in the bottom of the case, this can short out a fan motor or cause other damage.

Figure 9:
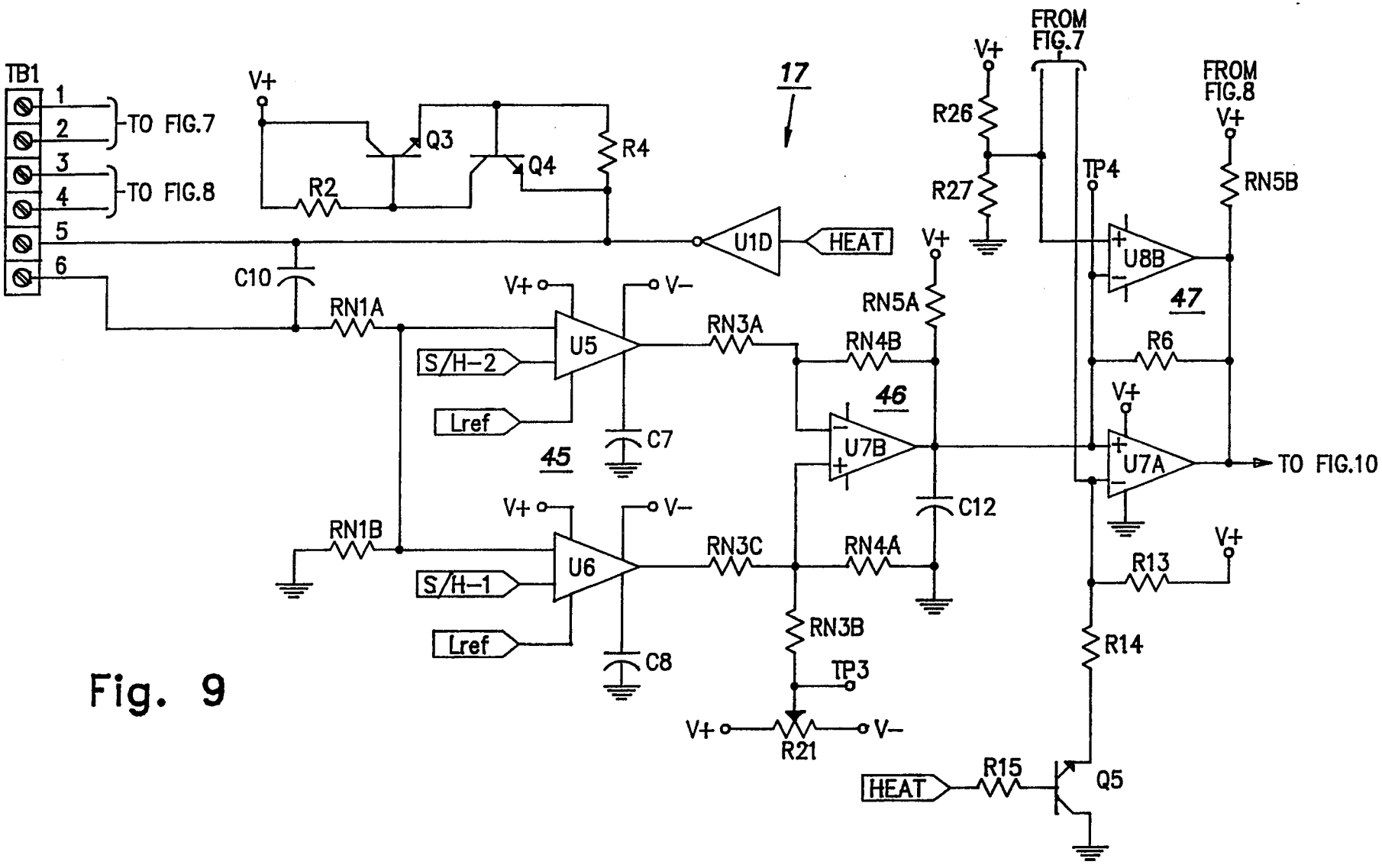
FIG. 9 is a circuit diagram of a plugged drain detection circuit.

The two terminals of this thermistor 44 are passed to the plugged drain detection circuit which has a sample and hold circuit 45, a difference amplifier 46 and comparators 47. The heat signal of FIG. 2 is applied at two places to the plugged drain detection circuit 17, as shown in FIG. 9. If the drain is operating normally, that is, it is open to drain water, then when the heat signal is applied to this thermistor 44 the voltage drop on resistance RN1B will be similar to the curve 38 in FIG. 3 with a large voltage drop between times T1 and T2. The sample and hold circuit 45 will sample these voltage drops at times T1 and T2 and pass them to the difference amplifier 46 which passes a signal to the comparators 47, and there will be no change supplied to the output circuit 18. However, should the drain 45A become plugged in any way, then when the heat signal is supplied to the thermistor 44, there will be only a small change in the voltage drop across RN1B because of the heat sinking capacity of the ice or water in the drain. Thus the result will be like the curve 39 in FIG. 3 with only a small change in the voltage drop. This is passed by the sample and hold circuit 45 to the difference amplifier 46 and to the comparators 47 which will then change state and supply a signal to the output circuit which is a signal to the frost detect terminals FD of the terminal board TB2. This may be used to energize an alarm or to turn off the refrigeration, or both, as desired.

The HEAT signal turns off U1C in the circuit of FIG. 7 which in turn allows power to be applied across the frost detect sensor thermistor 24. The amount of current flowing through the thermistor is dependent upon the initial temperature of the thermistor, the time duration the power is applied and the circuit around Q1 and Q2. This current is great enough for the thermistor to generate appreciable heat, sufficient to cause the resistance to change within the thermistor. It is this change which the circuit measures. As the quantity of heat dissipated by the thermistor is affected by any physical mass in intimate contact with it, there will be a distinct and measurable difference in the rate of change of the thermistor's characteristic resistance during this self-heating phase. In free air the rate of change will be large. If the thermistor is surrounded by frost or ice, the rate of change will be small since most of the heat generated by the thermistor will be drawn away from it thereby preventing enough heat to be generated to evoke an appreciable change of resistance within it.

The rate of change of the resistance of thermistor 24 is detected by measuring the voltage across RN1C or RN1B which, since it is in series with the self-heated thermistor, will vary inversely according to the resistance changes within the thermistor. This voltage is simultaneously applied to a pair of sample and hold circuits 34 including U3 and U4. Shortly after the self-heating power is applied to the thermistor, the S/H-1 signal causes U4 to record the instantaneous voltage at its input and retain that voltage. Approximately three seconds later, the S/H-2 signal then causes U3 to record a new instantaneous voltage which, because of the self-heating within the thermistor, will be a different voltage from that recorded previously by U4. Now that the two voltages have been recorded, the HEAT signal now causes U1C to turn on, effectively preventing any self-heating to continue.

The two voltage samples are now processed to make a determination as to whether to invoke a defrost request or not. U7C is biased as a difference amplifier 35 which takes the outputs of U4 and U3, finds the arithmetic difference, it also adds in an adjustable bias or offset from potentiometer R24 calibration. The output from U7C is applied to the inputs of several comparator circuits USD, U7D, and U8A. Together these comparators make a determination as to whether the voltage measurements taken across RN1C constitute a need to request that a defrost cycle be executed. Should there be a short circuit within the thermistor or its associated wiring or an open circuit, then this comparator circuit will prevent a false defrost.

Figure 10:
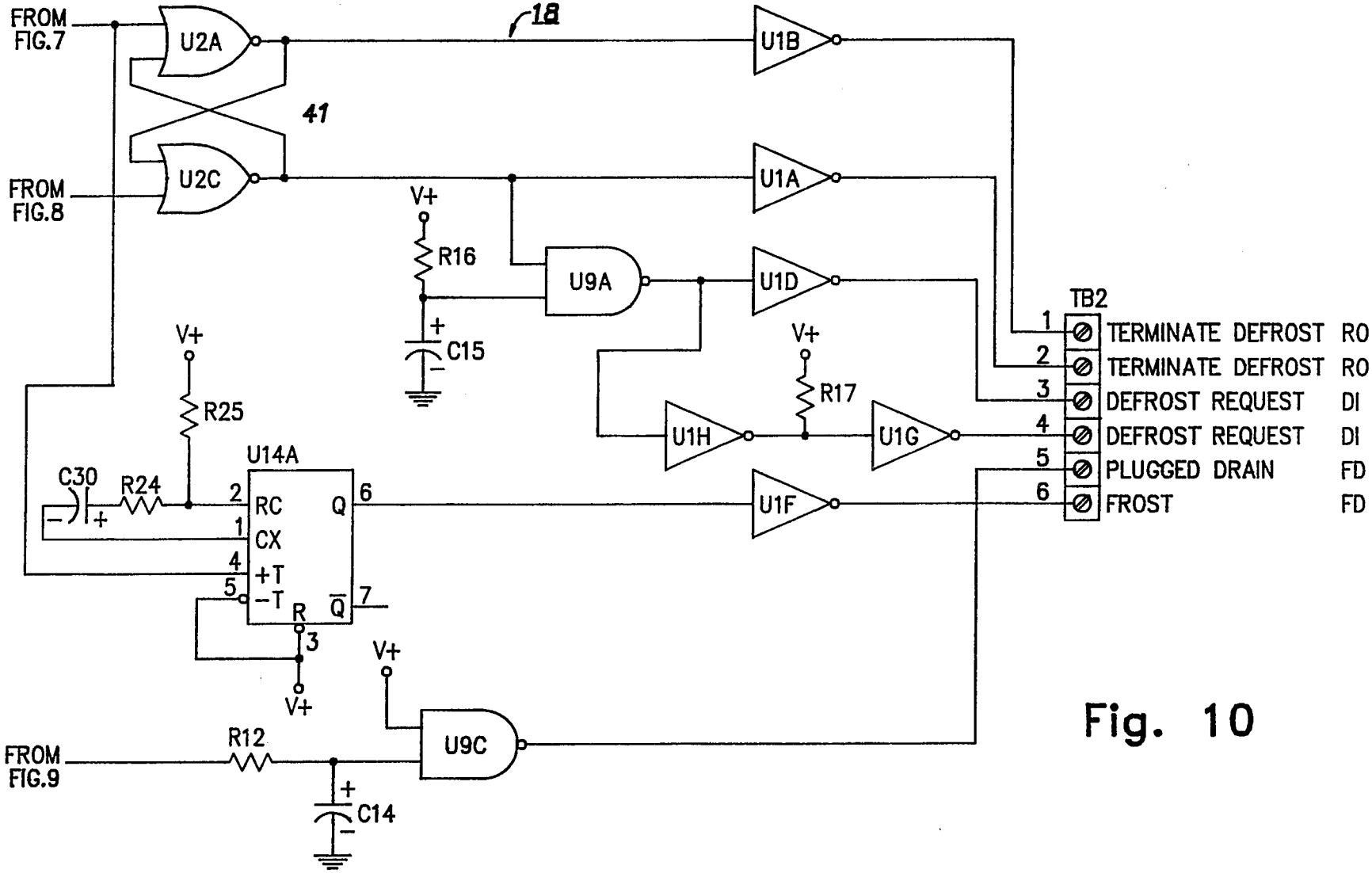
FIG. 10 is a circuit diagram of an output circuit.

Upon the circuit's determination that frost is present from the comparators 36, this will trigger U14A in the output circuit of FIG. 10 to cause the "FROST" output terminal to indicate the presence of FROST. This same signal also switches a flip-flop 41 composed of U2A and U2C which in turn drives U9A, U1E, U1H, and U1G to control the defrost request output terminals. U9A is set up mainly as a timer which prevents a false defrost request during initial power up of the device.

The state of the FROST output terminal will follow the status of the frost detect thermistor, that is, it will change state upon the elimination of the frost around the thermistor 24 (such as performing a defrost or any other reasons). The DEFROST REQUEST output terminals will not change state until the circuitry associated with the temperature with the third and fourth terminals in terminal board 1, TB1, determine that it is safe to terminate the defrost. This second thermistor 25 is positioned in such a fashion as to measure the temperature of its surroundings without any self-heating. When a defrost is in process some form of external heating is being applied to melt away the frost and ice, and this thermistor measures the temperature of a surface from which the frost is to be melted. When the resistance across this thermistor reaches a specified level as determined by applying a small voltage bias across it and measured by the circuitry associated with the USC, and calibrated by potentiometer R11, it is assumed that the frost has been removed since the temperature is now too warm for frost or ice to exist. Prior to reaching this temperature, any frost or ice will draw away much of the heat being applied preventing the surface to which this thermistor is attached from attaining a defrost terminate temperature. Upon U8C in FIG. 8 making a determination that the area being monitored by this thermistor 25 is sufficiently warm to have melted away the frost, a signal is generated at its output which activates U9B, in FIG. 8, which in turn clears the flip-flop 41, turns off the DEFROST REQUEST output terminals and turns on the terminate DEFROST output terminals.

In the preferred embodiment, the values of the various components are as follows:

LIST OF COMPONENTS

| Resistances | Value | Tolerance |
|---|---|---|
| R1, R2 | 1.74K | 1% |
| R3, R4 | 330 ohms | |
| R5, R6 | 680K | |
| R7 | 30.1K | 1% |
| R8 | 1K | 1% |
| R9 | 20K | 1% |
| R10 | 220K | |
| R11 | 50K | |
| R12 | 1M | 1% |
| R13 | 2K | 1% |
| R14 | 1K | 1% |
| R15 | 15K | |
| R16 | 1M | 1% |
| R17 | 2.2K | |
| R18 | 19.1K | 1% |
| R19 | 10K | 1% |
| R20, R21 | 10K | |
| R22 | 56 ohms | |
| R23 | 2.7M | |
| R24 | 56 ohms | |
| R25 | 2.7M | |
| R26, R27 | 2K | 1% |
| R28 | 1.5K | 1% |
| R29 | 1K | 1% |
| Resistance Networks | | |
| RN1 A-D | 1K | |
| RN2 A-D | 20K | |
| RN3 A-D | 20K | |
| RN4 A-E | 100K | |
| RN5 A-E | 15K | |
| Capacitors | | |

-continued

| LIST OF COMPONENTS | | |
|---|---|---|
| C5–C10 | .01UF | |
| C11, C12 | .47UF | |
| C13 | .01UF | |
| C14, C15 | 15UF 20V | |
| C17 | .01UF | |
| C18 | 15UF 20V | |
| C30 | 15UF 20V | |
| C31 | 15UF 20V | |
| Integrated Circuits | Circuit | Type |
| U1 A–H | ULN2803 | |
| U2 A–D | 4001 | NOR |
| U3–U6 | LF 398 | |
| U7, U8 | LM339 | |
| U9 A–C | 4093 | NAND |
| U12 | 555 | Timer |
| U13 | 4017 | |
| U14 A–B | 4538 | F-F |
| Transistors | | |
| Q1–Q5 | 2N3393 | |

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A detection assembly for frost or water in a refrigeration system having a cooling unit subject to frost build-up and defrost water to a drain, said assembly comprising, in combination:

a first thermal sensor normally exposed to air and mounted in said refrigeration system at a location subject to build-up of frost or water;

a detection circuit having an input from said first thermal sensor;

means in said detection circuit to energize said first thermal sensor with a voltage sufficiently high to cause said first thermal sensor to self-heat; and means to compare the resistance of said first thermal sensor at two different times to detect the presence of frost or water around said first thermal sensor and to generate a first signal;

said first signal connected to terminate the refrigeration to said cooling unit.

2. A detection assembly as set forth in claim 1, wherein said two different times are during the self-heating of said first thermal sensor.

3. A detection assembly as set forth in claim 2, wherein said comparator means generates said first signal when there is sufficient frost or water build-up to prevent an appreciable temperature and resistance change on said first thermal sensor at said two different times.

4. A detection assembly as set forth in claim 1, wherein at least one of said two times is during the self-heating of said first thermal sensor.

5. A detection assembly as set forth in claim 1, wherein one of said two times is after the self-heating of said first thermal sensor for a few seconds.

6. A detection assembly as set forth in claim 1, wherein one of said two times is near the beginning of self-heating of said first thermal sensor.

7. A detection assembly as set forth in claim 1, wherein one of said two times is near the end of self-heating of said first thermal sensor.

8. A detection assembly as set forth in claim 1, wherein said thermal sensor is a thermistor.

9. A detection assembly as set forth in claim in wherein said thermal sensor is a temperature dependent resistor.

10. A detection assembly as set forth in claim 1, including in said detection circuit a means to periodically heat said first thermal sensor to generate said first signal only if frost or water is present at said first thermal sensor.

11. A plugged drain detection assembly for a refrigeration system having a cooling unit subject to frost build-up and a defrost-to-drain, said assembly comprising, in combination:

a thermal sensor exposed to air and mounted in the refrigeration system drain;

a plugged drain detection circuit having an input from said thermal sensor;

means in said detection circuit to energize said thermal sensor with a voltage to cause said thermal sensor to self-heat; and means to compare the resistance of said thermal sensor at two different times to detect the presence of frost or water around said thermal sensor and to generate a plugged drain signal.

12. A plugged drain detection system as set forth in claim 11, wherein said thermal sensor is mounted in a defrost water drain of the refrigeration system.

13. A defrost-on-demand assembly for a refrigeration system having a cooling unit subject to frost build-up, said assembly comprising, in combination:

a first thermal sensor exposed to air and mounted a small distance from a cooling unit subject to frost build-up;

a frost detection circuit having an input from said first thermal sensor;

means in said detection circuit to energize said thermal sensor with a voltage to cause said thermal sensor to self-heat; and means to compare the resistance of said thermal sensor at two different times to detect the presence of frost around said thermal sensor and to generate a defrost initiate DI signal; and said DI signal connected to terminate the refrigeration to said cooling unit.

14. A defrost-on-demand assembly as set forth in claim 13, including said DI signal connected to initiate a defrost cycle wherein heat is applied to defrost said cooling unit;

a second thermal sensor mounted to be in good thermal contact with said cooling unit; and a defrost terminate circuit having an input from said second thermal sensor to terminate said defrost cycle.

15. A defrost-on-demand assembly as set forth in claim 13, including a mounting block having a mounting surface;

means to mount said mounting surface of said block on the cooling unit; and said first thermal sensor mounted in said mounting block.

16. A defrost-on-demand assembly as set forth in claim 15, including said second thermal sensor mounted in said mounting block to be in good thermal contact with said cooling unit.

17. A defrost-on-demand assembly as set forth in claim 14, including in said defrost terminate circuit a means to terminate the defrost cycle only when the temperature of said second thermal sensor is above 32° F.

18. A defrost-on-demand assembly as set forth in claim 14, including means in said terminate defrost circuit to determine when the temperature of said second thermal sensor rises to about 35° F., and to generate a defrost terminate signal RO to restart the refrigeration to the cooling unit.

* * * * *

UNITED STATES PATENT AND TRADEMARK OFFICE

CERTIFICATE OF CORRECTION

PATENT NO. : 5,345,775

DATED : September 13, 1994

INVENTOR(S) : Ralph G. Ridenour

It is certified that error appears in the above-identified patent and that said Letters Patent is hereby corrected as shown below:

Column 5, line 57, "USD" should be --U8D--;

Column 6, line 23, "USC" should be --U8C--; and

Column 8, line 6, please delete the second occurence of "in" and insert therefor --1,--.

Signed and Sealed this

Seventh Day of March, 1995

*Attest:*

*Attesting Officer*

BRUCE LEHMAN

*Commissioner of Patents and Trademarks*